US008212634B2

(12) United States Patent
Mina et al.

(10) Patent No.: US 8,212,634 B2
(45) Date of Patent: Jul. 3, 2012

(54) VERTICAL COPLANAR WAVEGUIDE WITH TUNABLE CHARACTERISTIC IMPEDANCE DESIGN STRUCTURE AND METHOD OF FABRICATING THE SAME

(75) Inventors: Essam Mina, South Burlington, VT (US); Guoan Wang, Burlington, VT (US)

(73) Assignee: International Business Machines Corporation, Armonk, NY (US)

( * ) Notice: Subject to any disclaimer, the term of this patent is extended or adjusted under 35 U.S.C. 154(b) by 450 days.

(21) Appl. No.: 12/478,385

(22) Filed: Jun. 4, 2009

(65) Prior Publication Data

US 2010/0315181 A1 Dec. 16, 2010

(51) Int. Cl.
*H01P 3/00* (2006.01)
*H01P 3/18* (2006.01)

(52) U.S. Cl. ..... 333/238; 333/246

(58) Field of Classification Search ..... 333/238, 333/246, 33, 204
See application file for complete search history.

(56) References Cited

U.S. PATENT DOCUMENTS 5,561,405 A 10/1996 Hoffmeister et al.
6,522,214 B1 * 2/2003 Harju et al. ..... 333/1
6,832,029 B2 12/2004 Roberson
7,103,488 B2 9/2006 Goren et al.
7,315,226 B2 * 1/2008 Tohya et al. ..... 333/182
2001/0040490 A1 11/2001 Tanaka
2005/0062137 A1 3/2005 Singh et al.
2007/0091974 A1 4/2007 Hu et al.

FOREIGN PATENT DOCUMENTS

JP 08-167804 6/1996
JP 2001-006941 1/2001
JP 2006-238057 9/2006
KR 10-0287646 4/2001

OTHER PUBLICATIONS

International Search Report dated Nov. 26, 2010 in International Application WO2010/141167.
W. Woods et al., "Vertically-stacked on-chip SiGe/BiCMOS/RFCMOS coplanar waveguides", Proceedings of the IEEE 2004 International Interconnect Technology Conference (IEEE Cat. No. 04TH8729), pp. 245-247, Jun. 7-9, 2004.

* cited by examiner

*Primary Examiner* — Stephen Jones
(74) *Attorney, Agent, or Firm* — Anthony Canale; Roberts Mlotkowski Safran & Cole, P.C.

(57) ABSTRACT

An on-chip vertical coplanar waveguide with tunable characteristic impedance, a design structure, and a method of making the same. An on-chip transmission line includes a signal line, an upper ground line spaced apart from and above the signal line, and a lower ground line spaced apart from and below the signal line. The signal line, the upper ground line and the lower ground line are substantially vertically aligned in a dielectric material.

20 Claims, 12 Drawing Sheets

VERTICAL COPLANAR WAVEGUIDE WITH TUNABLE CHARACTERISTIC IMPEDANCE DESIGN STRUCTURE AND METHOD OF FABRICATING THE SAME

FIELD OF THE INVENTION

The invention generally relates to on-chip transmission lines and, more particularly, to an on-chip vertical coplanar waveguide with tunable characteristic impedance, a design structure, and a method of making the same.

BACKGROUND

The performance of an on-chip interconnect, such as an on-chip transmission line, is a significant factor in affecting overall chip performance. On-chip transmission lines are often modeled before production begins in an effort to lessen design time. Due to the significance of an on-chip transmission line to overall chip performance, accurate models of the on-chip transmission line are necessary when evaluating high performance designs. Any error that is present in the model of the transmission line may result in an inaccurate estimate of the characteristic impedance and/or attenuation associated with the transmission line in the chip. Chips that are produced based on faulty modeling may not perform in the manner required by the design specification, and as such represent an inefficient use of time, effort, and capital.

A common type of on-chip transmission line is a coplanar waveguide. A traditional coplanar waveguide comprises a signal line flanked by two ground lines. All three lines, e.g., the signal line and the two ground lines, are formed in a common wiring level of a semiconductor structure and thus are coplanar in a substantially horizontal plane.

Traditional on chip coplanar waveguides are difficult to model because asymmetry of the semiconductor structure in the vicinity of the coplanar waveguide results in an asymmetric electrical field that is difficult to model. Difficulties in modeling traditional coplanar waveguides are compounded when the electrical field intersects air, e.g., above the coplanar waveguide, or silicon substrate, e.g., below the coplanar waveguide. This is because there are no highly accurate models for the effects of air and/or substrate coupling. As a result, rather than using modeling, most designers rely on hardware measurements of fabricated prototypes to verify chip designs, which slows down the design cycle and the time to market for the product.

Accordingly, there exists a need in the art to overcome the deficiencies and limitations described hereinabove.

SUMMARY

In a first aspect of the invention, there is an on-chip transmission line including a signal line, an upper ground line spaced apart from and above the signal line, and a lower ground line spaced apart from and below the signal line. The signal line, the upper ground line and the lower ground line are substantially vertically aligned in a dielectric material.

In another aspect of the invention, there is a method of fabricating a semiconductor structure. The method includes forming a lower ground line of an on-chip transmission line in at least one wiring level above an active device, forming a signal line of the on-chip transmission line in a second wiring level above the at least one wiring level, and forming an upper ground line of the on-chip transmission line in a third wiring level above the second wiring level.

In another aspect of the invention, there is a design structure tangibly embodied in a machine readable medium used for designing, manufacturing, or testing an integrated circuit. The design structure includes a signal line, an upper ground line spaced apart from and above the signal line, and a lower ground line spaced apart from and below the signal line. The signal line, the upper ground line and the lower ground line are substantially vertically aligned in a dielectric material.

BRIEF DESCRIPTION OF THE SEVERAL VIEWS OF THE DRAWINGS

The present invention is described in the detailed description which follows, in reference to the noted plurality of drawings by way of non-limiting examples of exemplary embodiments of the present invention.

DETAILED DESCRIPTION

The invention generally relates to on-chip transmission lines and, more particularly, to an on-chip vertical coplanar waveguide with tunable characteristic impedance, a design structure, and a method of making the same. In embodiments, an on-chip transmission line comprises a signal line formed in a wiring level on an active device. A first ground line is formed in a wiring level below the signal line and is separated from the signal line by dielectric material. A second ground line is formed in a wiring level above the signal line and is also separated from the signal line by dielectric material. The signal line and the two ground lines are vertically aligned in the dielectric material, which results in a substantially symmetric electrical field for the vertical coplanar waveguide. In this manner, implementations of the invention provide a design structure that is easier to accurately model.

In accordance with aspects of the invention, the characteristic impedance of the vertical coplanar waveguide can be tuned, e.g., adjusted, by varying the thickness (e.g., horizontal dimension) of the signal line and/or ground lines. In accordance with additional aspects of the invention, the characteristic impedance of the vertical coplanar waveguide can be tuned by forming metal strips on either side of the vertical coplanar waveguide along the length of the vertical coplanar waveguide. For example, the characteristic impedance of the vertical coplanar waveguide may be affected by: the horizontal spacing between the vertical coplanar waveguide and the metal strips; the spacing between the metal strips along the length of the vertical coplanar waveguide; the dimension of the metal strips along the length of the vertical coplanar waveguide; and/or floating or connecting the metal strips to the ground lines of the vertical coplanar waveguide.

Figure 1:
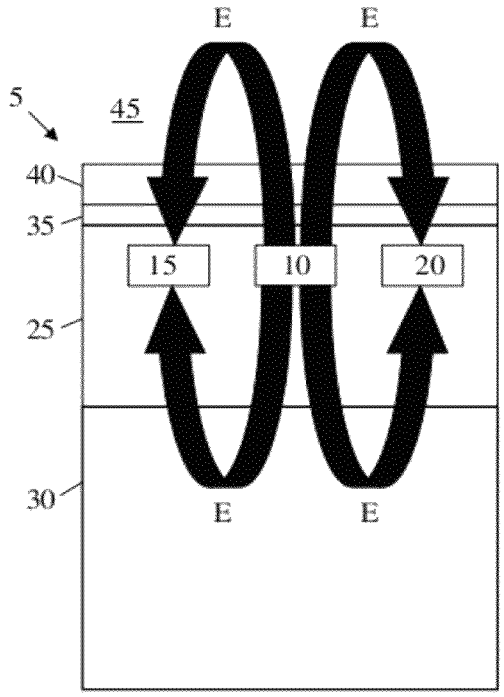
FIG. 1 shows a horizontal coplanar waveguide.

FIG. 1 shows a horizontal coplanar waveguide 5 including a conductive signal line 10 and conductive ground lines 15, 20 formed in an oxide layer 25. The oxide layer 25 is formed on a silicon substrate 30. A nitride layer 35 and a passivation layer 40 (e.g., polyimide) are formed on the oxide layer 25.

The top surface of the passivation layer 40 is typically in communication with air 45. Arrows "E" represent the electrical field emanating from the signal line 10 and ending at the ground lines 15, 20.

As depicted in FIG. 1, the electrical field "E" that exists over of the horizontal coplanar waveguide 5 passes through different layers of different materials than the electrical field "E" that exists under the horizontal coplanar waveguide. More specifically, at the top of the horizontal coplanar waveguide 5, the electrical field "E" passes through a thin portion of the oxide layer 25, the nitride layer 35, the passivation layer 40, and air 45. On the other hand, at the bottom of the horizontal coplanar waveguide 5, the electrical field "E" passes through a thick portion of the oxide layer 25 and the silicon substrate 30. The asymmetry in materials surrounding the horizontal coplanar waveguide 5 results in an asymmetric electrical field "E" that is difficult to model. The difficulty in modeling the horizontal coplanar waveguide 5 is further compounded by the lack of accurate models for the effects of air 45 and the silicon substrate 30 on the electrical field "E".

The horizontal coplanar waveguide 5 depicted in FIG. 1 also suffers a performance drawback due to the electrical field "E" intersecting the silicon substrate 30. In CMOS technology, the effect of the low-resistivity silicon substrate 30 electrically coupling to the signal line 10 and ground lines 15, 20 increases the on-chip transmission line insertion loss. Loss-inducing characteristics associated with such substrate coupling negatively affect the RF performance of the horizontal coplanar waveguide 5.

Figure 2:
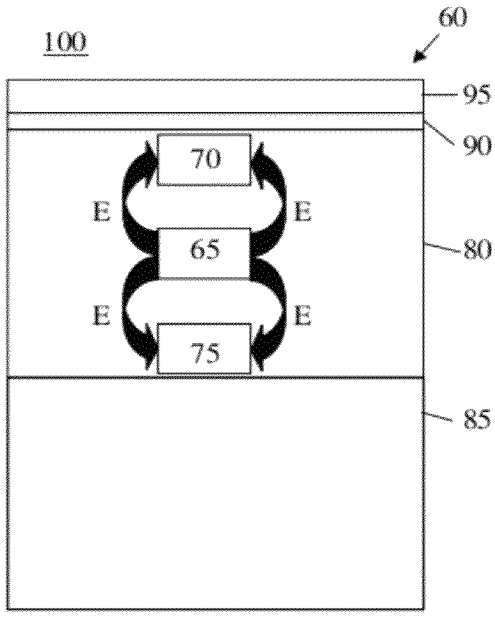
FIGS. 2-4 show vertical coplanar waveguides in accordance with aspects of the invention.

FIG. 2 shows a vertical coplanar waveguide 60 in accordance with aspects of the invention. In embodiments, the vertical coplanar waveguide 60 includes a conductive signal line 65, conductive upper ground line 70, and conductive lower ground line 75 formed in substantial vertical alignment with each other in a dielectric material 80. The dielectric material 80 may be formed over a silicon substrate 85 of an active device. A nitride layer 90 and passivation layer 95 may be formed over the oxide layer 80, with the upper surface of the passivation layer 95 exposed to air 100. The dielectric material 80 may comprise, but is not limited to, a high-k dielectric, a low-k dielectric, an ultra low-k dielectric, oxide, etc. For example, the dielectric material 80 may comprise borophosphosilicate glass (BPSG) or high density plasma (HDP) oxide.

As depicted in FIG. 2, the electrical field "E" of the vertical coplanar waveguide 60 exists completely or almost completely within a single type of material, e.g., the dielectric material 80. This results in a more symmetric electrical field "E" for the vertical coplanar waveguide 60 when compared to the horizontal coplanar waveguide 5 of FIG. 1. As such, the vertical coplanar waveguide 60 is easier to model when compared to the horizontal coplanar waveguide 5 of FIG. 1.

Still referring to FIG. 2, the air 100 and the silicon substrate 85 have little effect on the electrical field "E" of the vertical coplanar waveguide 60 due to the vertical arrangement of the signal line 65, upper ground line 70, and lower ground line 75 in the dielectric material 80. As such, the vertical coplanar waveguide 60 can be more accurately modeled when compared to the horizontal coplanar waveguide 5 of FIG. 1. Moreover, because the electrical field is essentially contained within the dielectric material 80, the substrate coupling effect is minimized with the vertical coplanar waveguide 60 in accordance with aspects of the invention. Accordingly, the vertical coplanar waveguide 60 has better loss characteristics than the horizontal coplanar waveguide 5 of FIG. 1.

Figure 3:
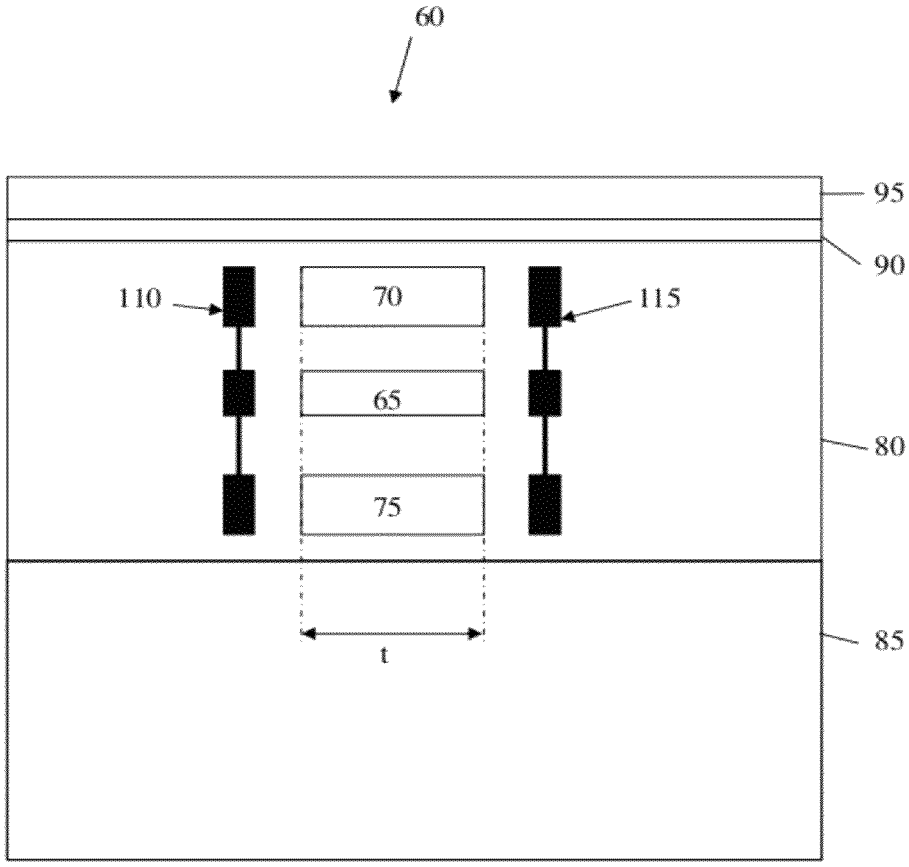

FIG. 3 shows optional metal strips 110, 115 on either side of the vertical coplanar waveguide 60 in accordance with aspects of the invention. In embodiments, the metal strips 110, 115 are formed in the dielectric material 80 to the left and right of the signal line 65, upper ground line 70, and lower ground line 75. As discussed in greater detail herein, the characteristic impedance of the vertical coplanar waveguide 60 can be tuned to a specific desired value by providing the metal strips 110, 115 on either side of the signal line 65, upper ground line 70, and lower ground line 75. The strips may be directly connected to the ground plane (e.g., upper ground line 70 and lower ground line 75), or may be floating (e.g., not directly connected to the ground plane). The characteristic impedance of the vertical coplanar waveguide 60 can also be tuned by varying the thickness "t" of the signal line 65, upper ground line 70, and lower ground line 75.

Figure 4:
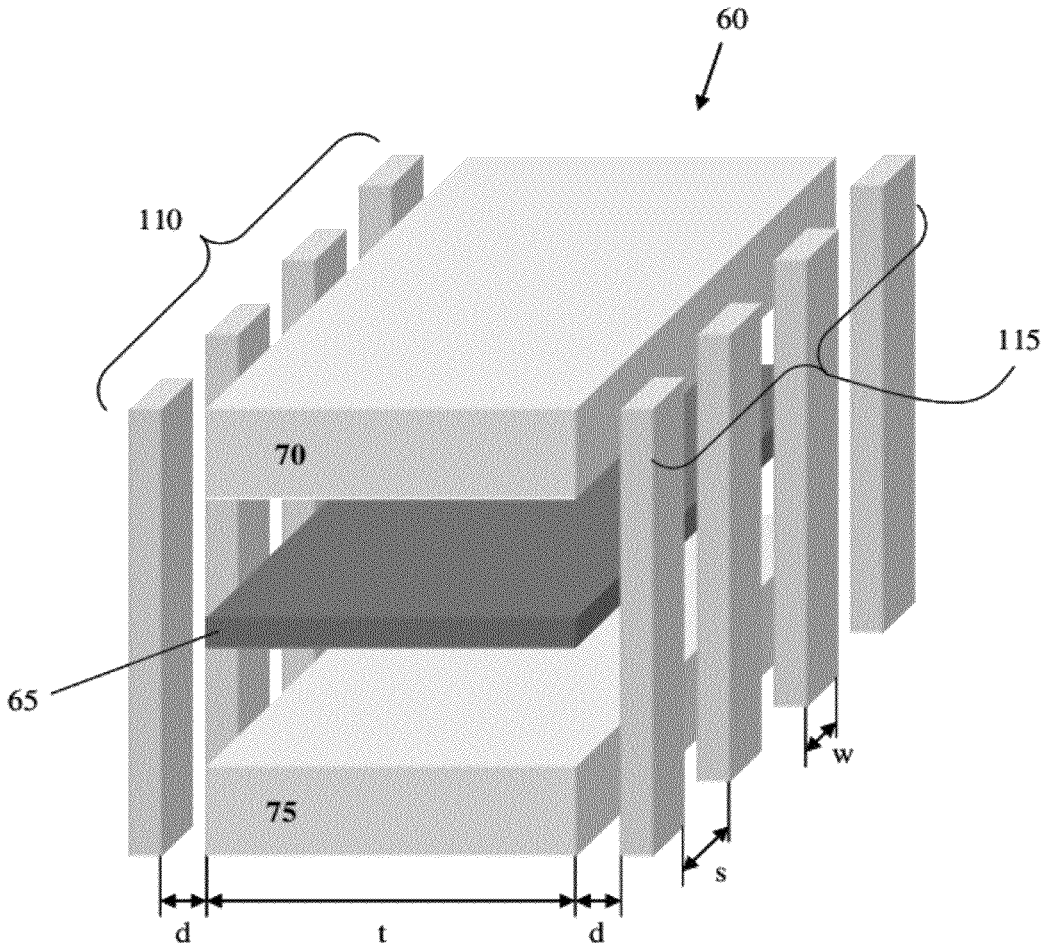

FIG. 4 shows a perspective view of a vertical coplanar waveguide 60 comprising a vertically aligned signal line 65, upper ground line 70, and lower ground line 75 in accordance with aspects of the invention. Pluralities of metal strips 110, 115 are arranged to the left and right of the vertical coplanar waveguide 60 along the length of the vertical coplanar waveguide 60 in a vertical array. Dimension "t" represents the thickness of the signal line 65, upper ground line 70, and lower ground line 75 in the horizontal direction. Dimension "d" represents the distance between the vertical coplanar waveguide 60 and the metal lines 110, 115 in the horizontal direction. Dimension "w" represents the width of the metal strips 110, 115, and dimension "s" represents the spacing between the metal strips 110, 115 in a direction that is orthogonal to the horizontal and vertical directions (e.g., along the length of the vertical coplanar waveguide 60). The dimensions "t", "d", "w", and "s" can vary depending on the particular application and design, with some exemplary non-limiting dimensions discussed below.

The capacitance between the ground plane (e.g., upper and lower ground lines 70, 75) and the signal plane (e.g., signal line 65) can be varied by altering any one or more of the "t", "d", "w", and "s" dimensions. Characteristic impedance is defined as $Z_o$=SQRT(L/C), where "L" is inductance per unit length and "C" is capacitance per unit length. Therefore, the characteristic impedance of the vertical coplanar waveguide 60 can be tuned by appropriately selecting the "t", "d", "w", and "s" dimensions. In this manner, implementations of the invention may be used to achieve a characteristic impedance in the range of about 35 Ohm to about 75 Ohm, preferably about 50 Ohm. However, the invention is not limited to these values, and any desired characteristic impedance may be sought by adjusting the "t", "d", "w", and "s" dimensions.

Figure 5:
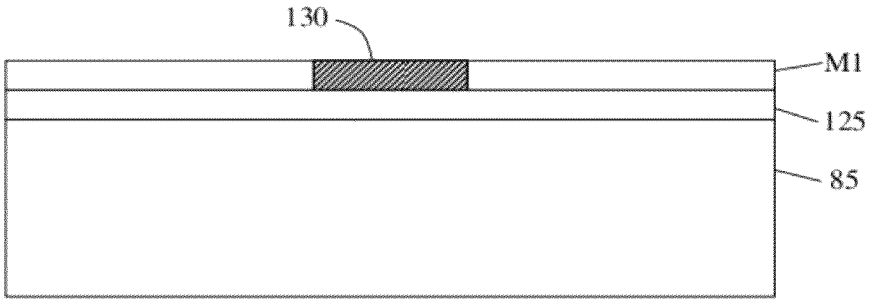
FIGS. 5-7 show side views of structures and respective processing steps in accordance with aspects of the invention.
Figure 6:
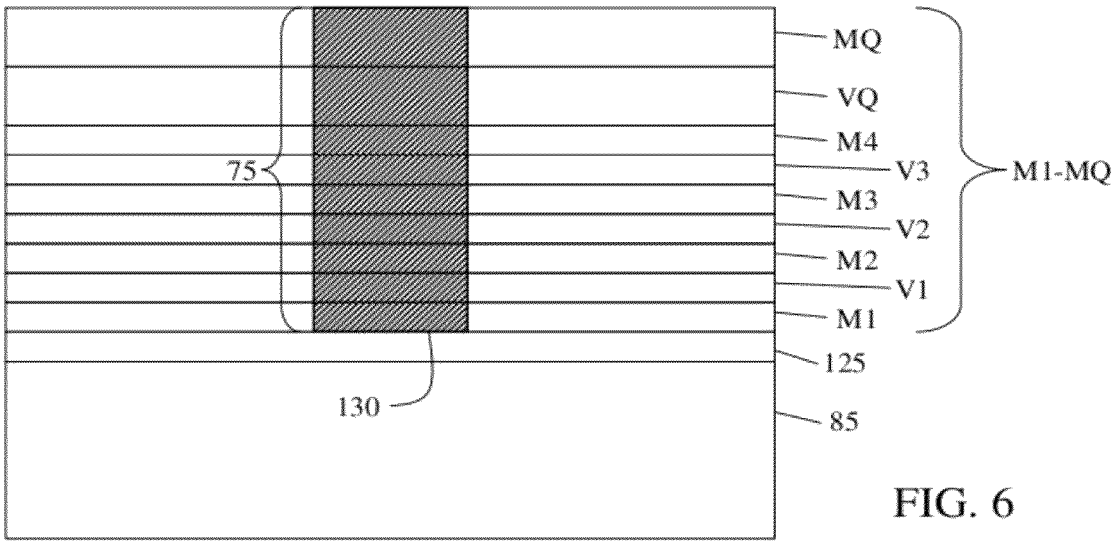
Figure 7:
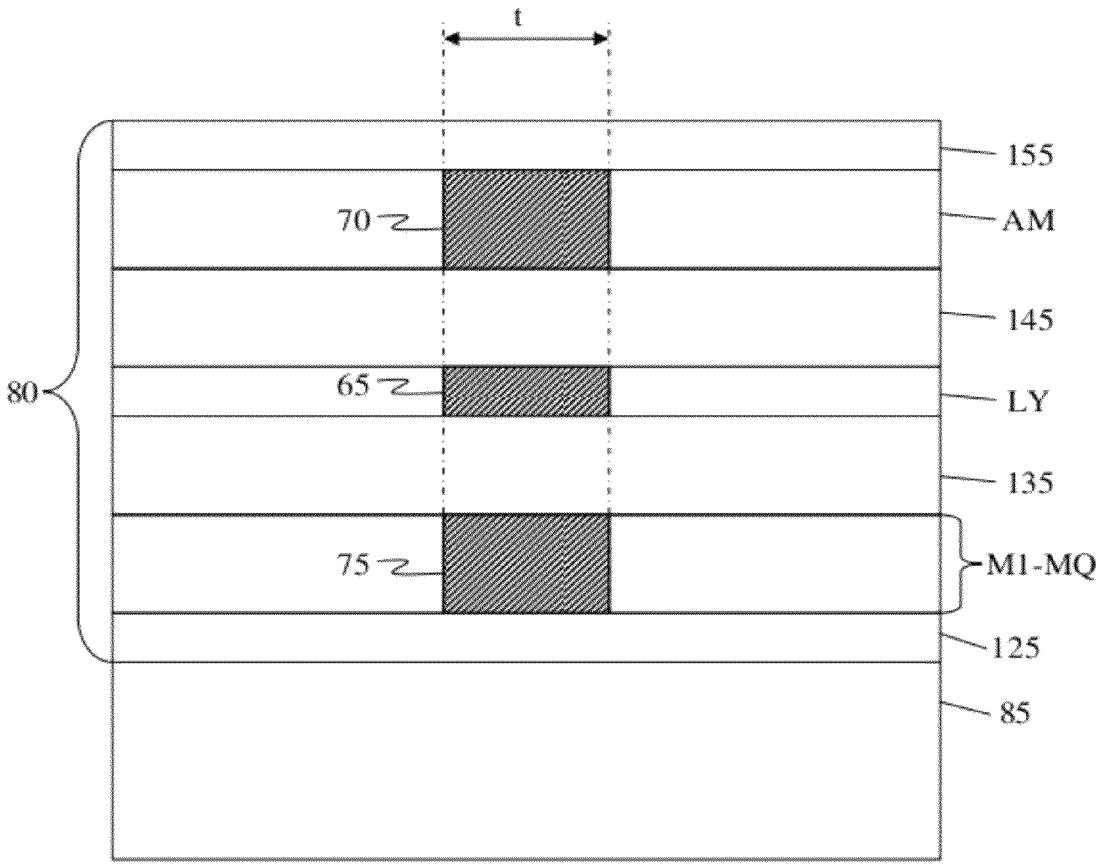

In accordance with aspects of the invention, the structures depicted in FIGS. 2-4 may be fabricated as layered semiconductor structures using conventional processing techniques. For example, FIGS. 5-7 show structures and respective processing steps for forming transmission line structures in accordance with aspects of the invention. Specifically, FIG. 5 shows a cross section of an exemplary semiconductor structure comprising a substrate 85 and dielectric layer 125 formed thereon. The substrate 85 may be formed using conventional processing techniques, and may include, for example, a silicon substrate having semiconductor devices (e.g., gates, source/drain regions, etc.) formed therein. The dielectric layer 125 may be formed using conventional processes, and may be composed of any suitable material, including, but not limited, high k dielectric, low k dielectric, ultra low k dielectric, etc. For example, the dielectric layer 125 may comprise any suitable oxide material that corresponds to the dielectric material 80 described above with respect to FIGS. 2 and 3.

Still referring to FIG. 5, a wiring level M1 is formed on dielectric layer 125. In embodiments, the wiring level M1 is composed of the same material as the dielectric layer 125, such as, for example, oxide material. A conductor portion 130 is formed in the wiring level M1 using conventional lithographic etching and deposition processes. The conductor portion 130 may be composed of any suitable conducting material, including, but not limited to: copper, aluminum, alloys, etc., and may be formed using conventional processes.

FIG. 6 shows the structure of FIG. 5, onto which additional wiring levels M2, M3, M4 and MQ and via levels V1, V2, V3, and VQ have been formed. In embodiments, all of the wiring levels M2-MQ and via levels and V1-VQ are composed of the same material as the first wiring level M1, such as, for example, oxide. Moreover, each wiring level M2-MQ and via level V1-VQ includes a respective conductor portion similar to conductor portion 130. The plurality of respective conductor portions are structured and arranged to form lower ground line 75 described above with respect to FIGS. 2-4. In this manner, the lower ground line 75 spans plural wiring levels and via levels.

FIG. 7 shows the structure of FIG. 6, onto which additional wiring levels 135, LY, 145, AM, and 155 are formed over the M1-MQ levels. In embodiments, all of the wiring levels 135, LY, 145, AM, and 155 are composed of the same material as wiring levels M1-MQ, such as, for example, oxide. In accordance with aspects of the invention, the signal line 65 is formed in wiring level LY and the upper wave guide 70 is formed in the wiring level AM. The signal line 65 and upper ground line 70 may be made of any suitable conducting material, including, but not limited to: copper, aluminum, alloys, etc., and may be formed using conventional processes.

The features of FIGS. 5-7 may be formed using conventional techniques, such as, standard back end of line (BEOL) processes. For example, these features may be formed using manufacturing processes including, but not limited to: photolithographic masking and exposure, etching (e.g., reactive ion etching (RIE), etc.), metallization (e.g., chemical vapor deposition (CVD), etc.), and planarizing and polishing processes (e.g., chemical mechanical polishing (CMP), etc.). Moreover, additional features not shown in FIGS. 5-7 may be used with implementations of the invention. For example, barrier material may be employed as liners, caps, etc.

Furthermore, the various levels depicted in FIGS. 5-7 may have any suitable height, and may be of differing heights relative to each other. For example, wiring levels M1-MQ may have a combined height of about 3.56 μm, level 135 may have a height of about 4 μm, level LY may have a height of about 1.25 μm, level 145 may have a height of about 4 μm, and level AM may have a height of about 4 μm. However, the invention is not limited to these values, and any suitable heights may be employed. Moreover, the invention is not limited to the number of wiring levels shown. Rather, aspects of the invention can be used with a semiconductor device having any number of wiring levels (e.g., analog devices, digital devices, etc.)

Even further, the upper ground line 70, lower ground line 75, and the signal line 65 may be of any suitable thickness "t". As depicted in FIGS. 3 and 7, the upper ground line 70, lower ground line 75, and the signal line 65 all have the same thickness "t". However, the invention is not limited to this configuration; instead, the upper ground line 70, lower ground line 75, and the signal line 65 may each have different respective thicknesses "t". Moreover, the upper ground line 70 and the signal line 65 are not confined to a single respective wiring level, but may span plural wiring levels (and via levels, if present). Similarly, although shown as spanning multiple levels M1-MQ, the lower ground line 75 is not restricted to such an implementation, but rather may equally be formed in a single level.

Although not depicted in FIGS. 5-7, the metal strips 110 and 115 may be formed substantially concurrently with the upper ground line 70, lower ground line 75, and the signal line 65 in the levels of the layered semiconductor structure shown in FIGS. 5-7. That is to say, conductive material corresponding to the metal strips 110 and 115 may be formed at selective locations in selected wiring levels and via levels using conventional processes. By forming the metal strips 110 and 115 in selected locations within the wiring levels, the "d", "w", and "s" dimensions (described above with respect to FIG. 4) can be tailored in any desired manner. As discussed above with respect to FIG. 4, the capacitance between the ground plane (e.g., upper and lower ground lines 70, 75) and the signal plane (e.g., signal line 65) can be changed by changing any one or more of the "t", "d", "w", and "s" dimensions. Therefore, the characteristic impedance of the vertical coplanar waveguide 60 can be tuned by appropriately selecting the "t", "d", "w", and "s" dimensions during the processing steps associated with FIGS. 5-7. In accordance with aspects of the invention, the dimensions "t", "d", "w", and "s" may be selected as any desired value.

Figure 8:
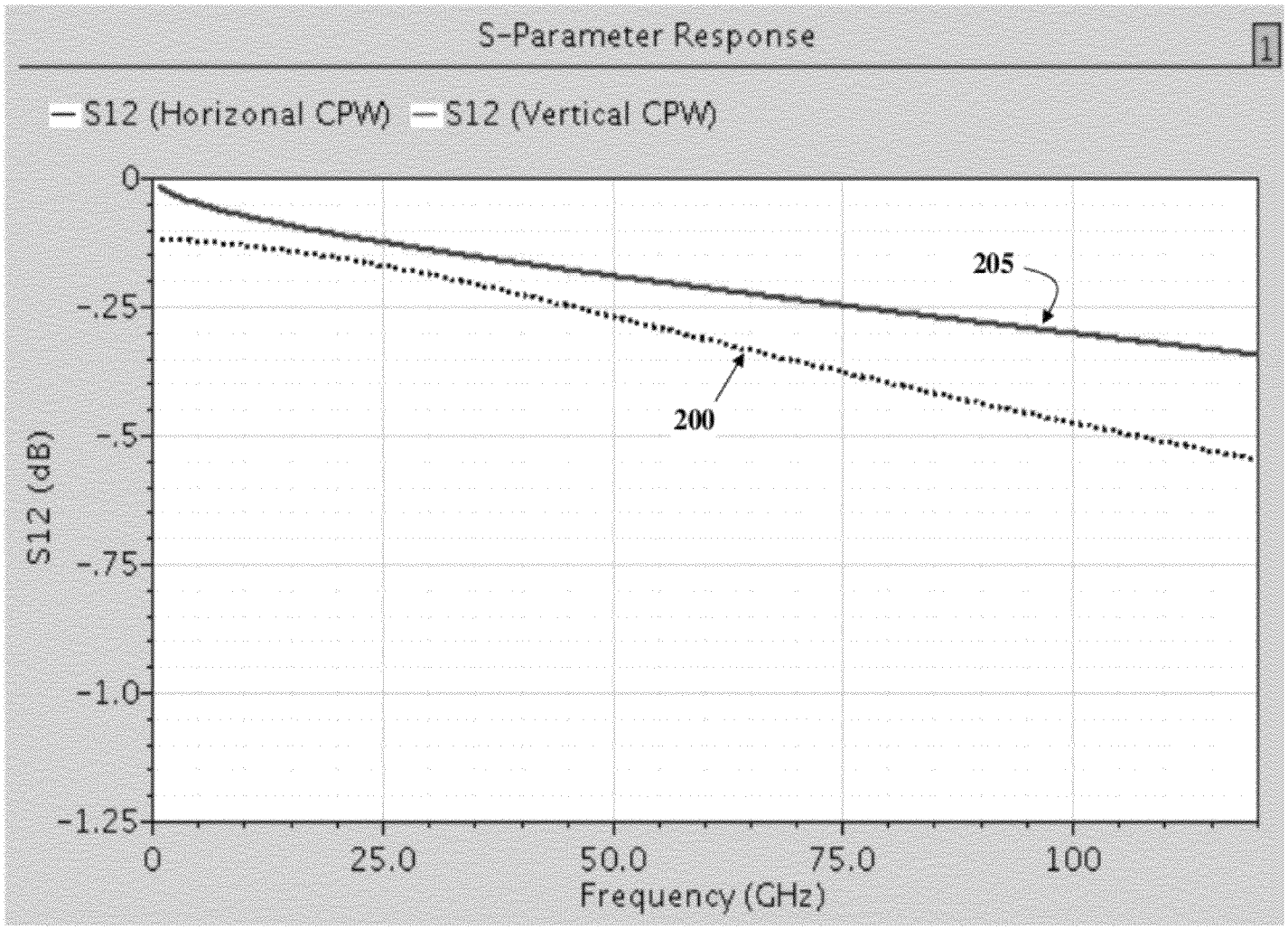
FIGS. 8-13 show data plots of parameters of circuits in accordance with aspects of the invention.

FIG. 8 shows a comparison of insertion loss values between a horizontal coplanar waveguide and a vertical coplanar waveguide in accordance with aspects of the invention. Curve 200 represents insertion loss for a horizontal coplanar waveguide formed in the LY layer and having a width of 1.52 μm. Curve 205 represents a vertical coplanar waveguide formed in accordance with FIGS. 5-7 and having a "t" dimension of 1.25 μm. As shown in FIG. 8, the vertical coplanar waveguide experiences less insertion loss than the horizontal coplanar waveguide.

Figure 9:
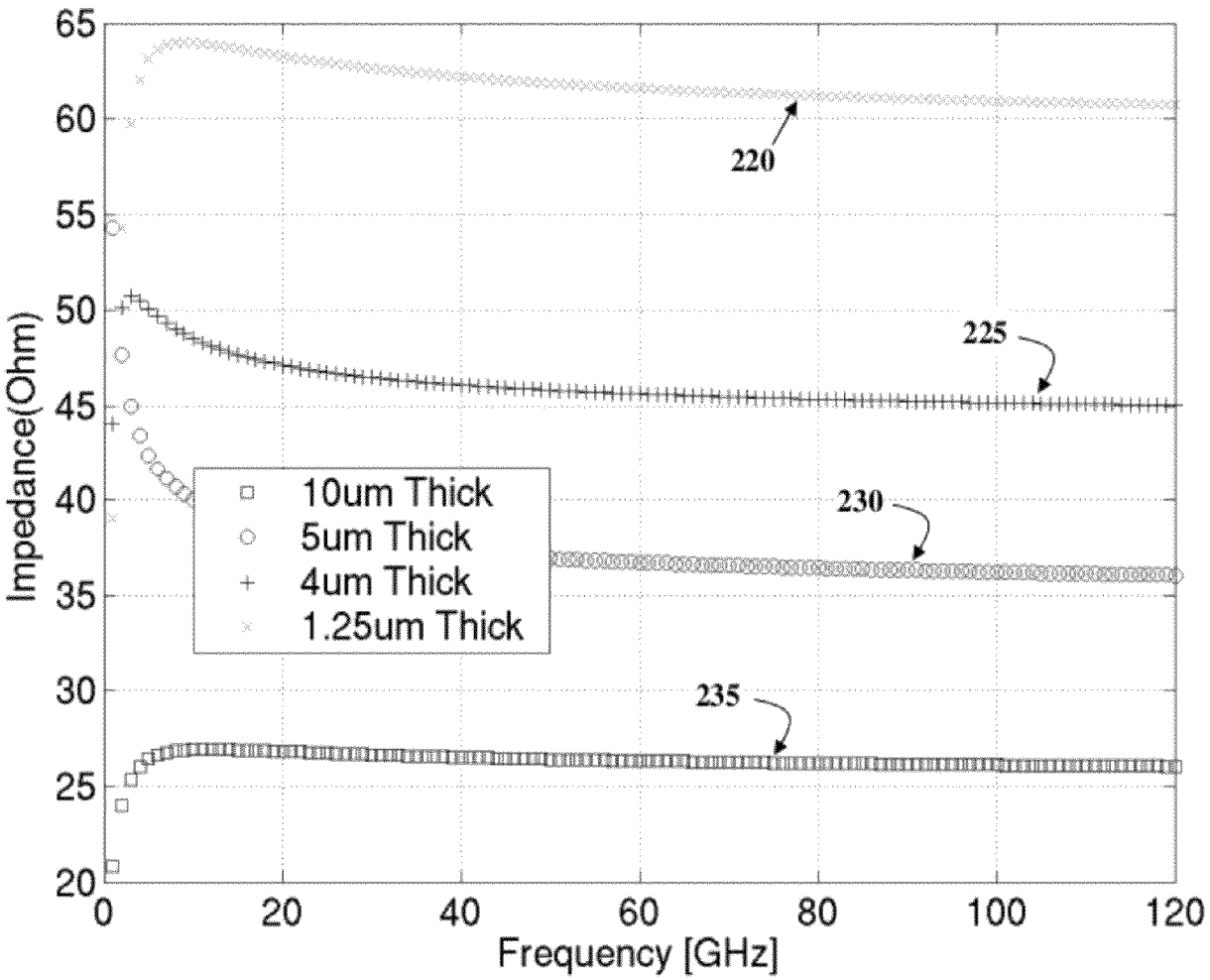

FIG. 9 shows a comparison of characteristic impedance values for a vertical coplanar waveguide formed in accordance with aspects of the invention. The four curves 220, 225, 230, 235 correspond to respective vertical coplanar waveguides formed in accordance with FIGS. 5-7 and without any metal strips (e.g., elements 110, 115), and having "t" dimensions of 1.25 μm, 4 μm, 5 μm, and 10 μm, respectively. As shown in FIG. 9, the characteristic impedance decreases as the "t" dimension increases.

Figure 10:
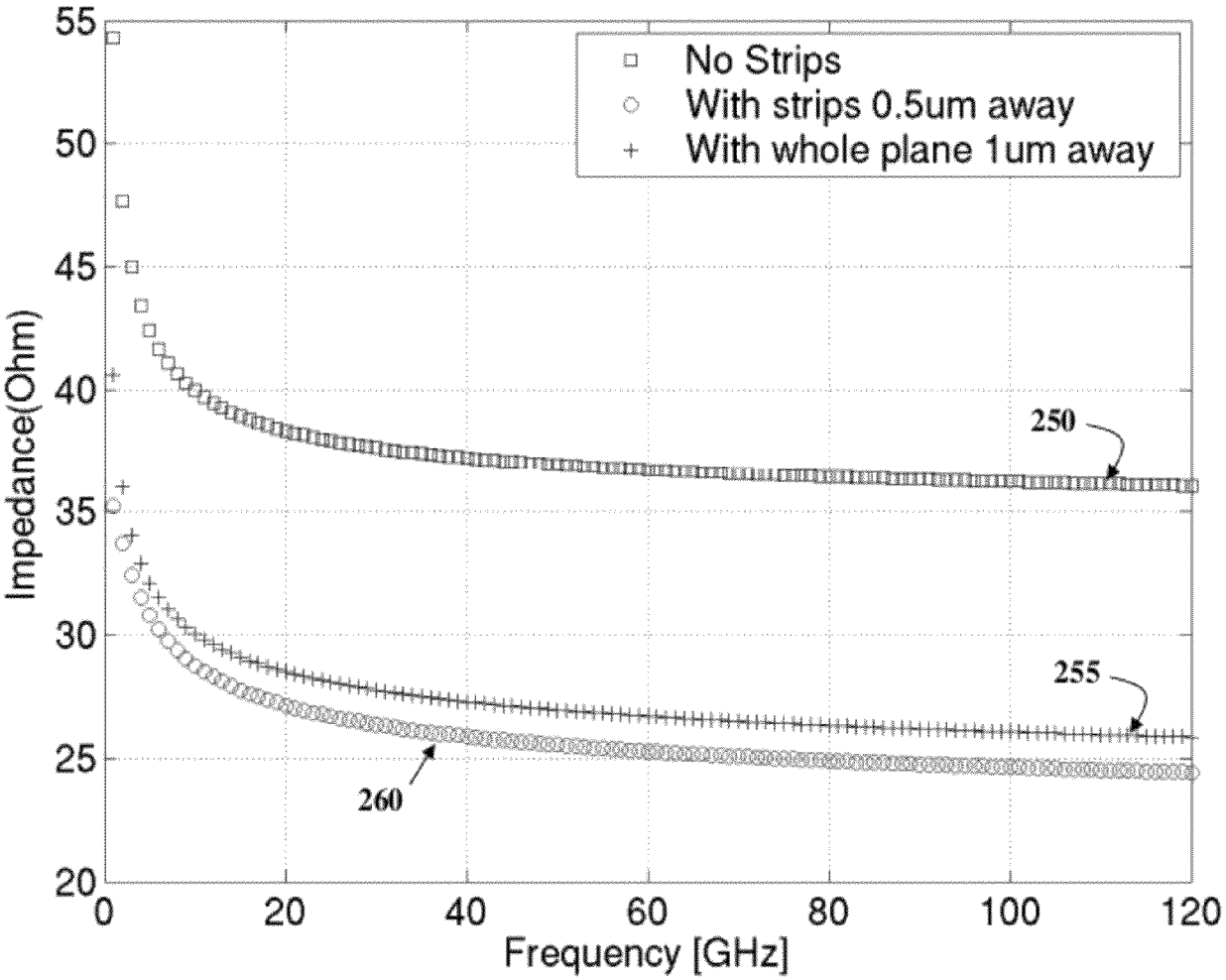

FIG. 10 shows a comparison of characteristic impedance values for a vertical coplanar waveguide formed in accordance with aspects of the invention. The three curves 250, 255, and 260 correspond to respective vertical coplanar waveguides formed in accordance with FIGS. 5-7 each having a "t" dimension of 5 μm. Curve 250 corresponds to a vertical coplanar waveguide without metal strips (e.g., 110, 115). Curve 255 corresponds to a vertical coplanar waveguide having floating metal strips in which "d" equals 1.0 μm and "s" equals 0. Curve 260 corresponds to a vertical coplanar waveguide having metal strips in which "d" equals 0.5 μm, "w" equals 2 μm, and "s" equals 2 μm. The data depicted in FIG. 10 demonstrates that the use of the metal strips has an effect on the impedance.

Figure 11:
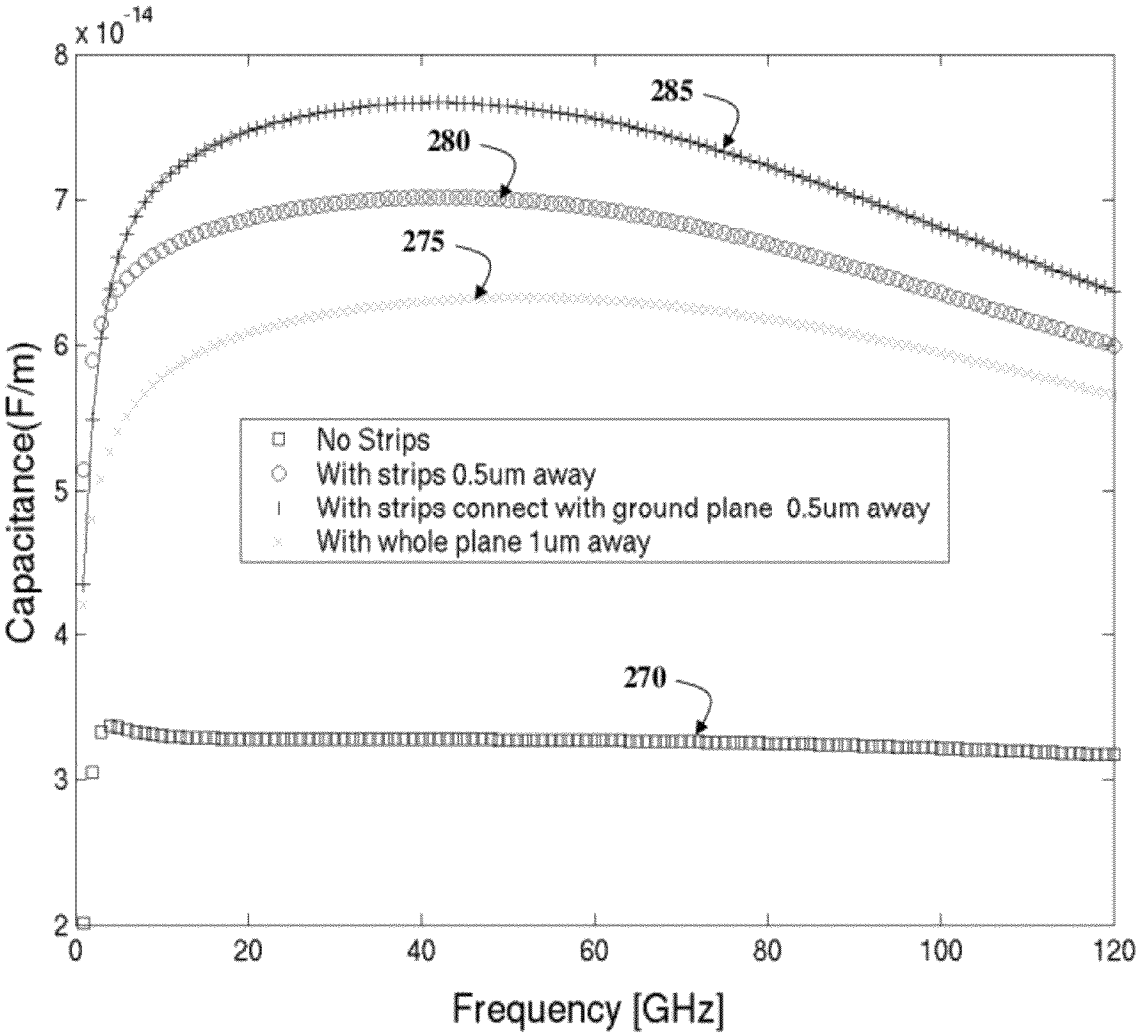

FIG. 11 shows a comparison of capacitance per unit length of a vertical coplanar waveguide formed in accordance with aspects of the invention. The four curves 270, 275, 280, 285 correspond to respective vertical coplanar waveguides formed in accordance with FIGS. 5-7 each having a "t" dimension of 10 μm. Curve 270 corresponds to a vertical coplanar waveguide without metal strips (e.g., 110, 115). Curve 275 corresponds to a vertical coplanar waveguide having floating metal strips in which "d" equals 1.0 μm and "s" equals 0 (e.g., the metal strip is a solid plate running along a length of the vertical coplanar waveguide). Curves 280 and 285 each corresponds to a vertical coplanar waveguide having metal strips in which "d" equals 0.5 μm, "w" equals 2 μm, and "s" equals 2 μm. Curve 280 corresponds to a configuration in which the metal strips are not directly connected to the vertical coplanar waveguide (e.g., the metal strips are floating), while curve 285 corresponds to a configuration in which the metal strips are directly connected to the ground plane (e.g., strips 110 and 115 are directly connected to the upper and lower ground lines 70, 75).

Figure 12:
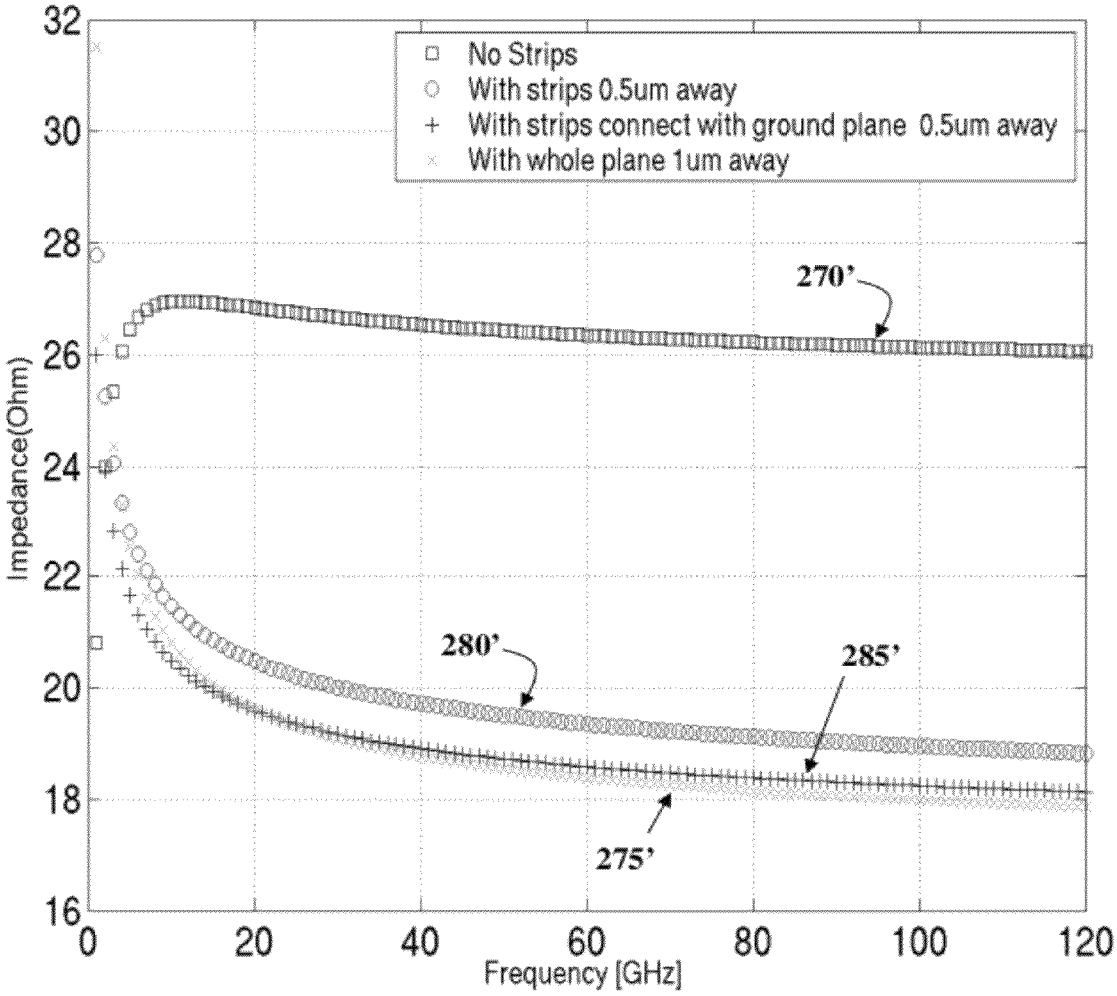

FIG. 12 shows a comparison of characteristic impedance values corresponding the capacitance values depicted in FIG. 11. More specifically, curves 270', 275', 280', and 285' depict impedance corresponding to curves 270, 275, 280, and 285, respectively. The data depicted in FIGS. 11 and 12 demonstrates that the metal strips have an effect on the capacitance and, therefore, the impedance.

Figure 13:
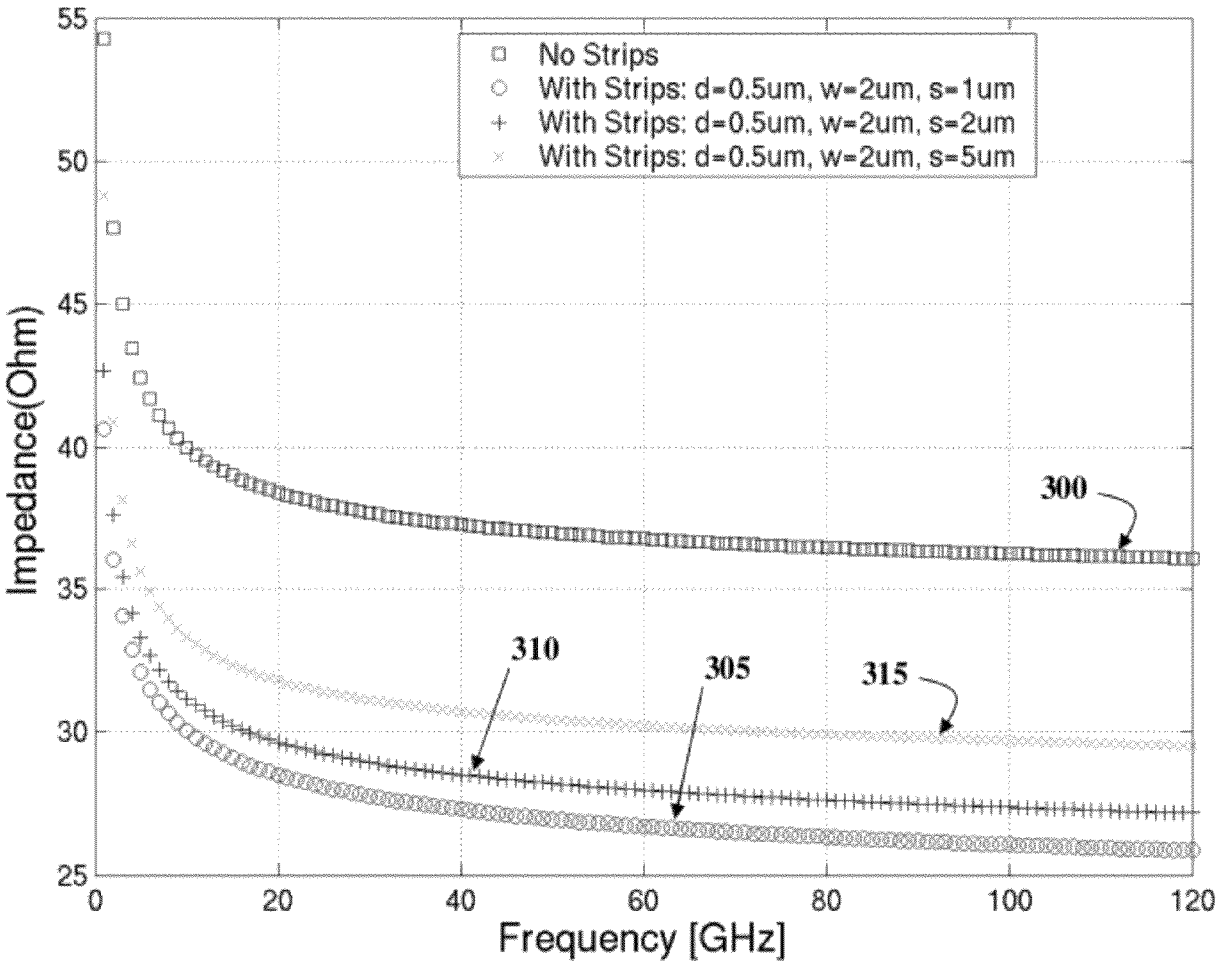

FIG. 13 shows a comparison of characteristic impedance values for a vertical coplanar waveguide formed in accordance with aspects of the invention. The four curves 300, 305, 310, and 315 correspond to respective vertical coplanar waveguides formed in accordance with FIGS. 5-7 each having a "t" dimension of 15 μm. Curve 300 corresponds to a vertical coplanar waveguide without metal strips (e.g., 110, 115). Curves 305, 310, and 315 correspond to a vertical coplanar waveguide having floating metal strips in which "d" equals 0.5 μm, "w" equals 2 μm, and having varying "s" dimensions. Particularly, "s" equals 1 μm for curve 305, "s" equals 2 μm for curve 310, and "s" equals 5 μm for curve 315. The data depicted in FIG. 13 demonstrates that the spacing between the metal strips has an effect on the impedance.

As described herein, the vertical coplanar waveguide formed in accordance with aspects of the invention has better insertion loss compared to a traditional horizontal coplanar waveguide due to a reduction of substrate loss. Moreover, the vertical coplanar waveguide is easier to model than a horizontal coplanar waveguide due to the symmetry of the electrical field associated with the vertical coplanar waveguide. Furthermore, the characteristic impedance of the vertical coplanar waveguide can be tuned for a wide range by altering the thickness (e.g., "t" dimension) of the signal line and ground lines. The characteristic impedance may also be tuned by adding metal strips alongside the signal line and ground lines and by appropriately selecting the "d", "s", and "w" dimensions associated with the metal strips.

Figure 14:
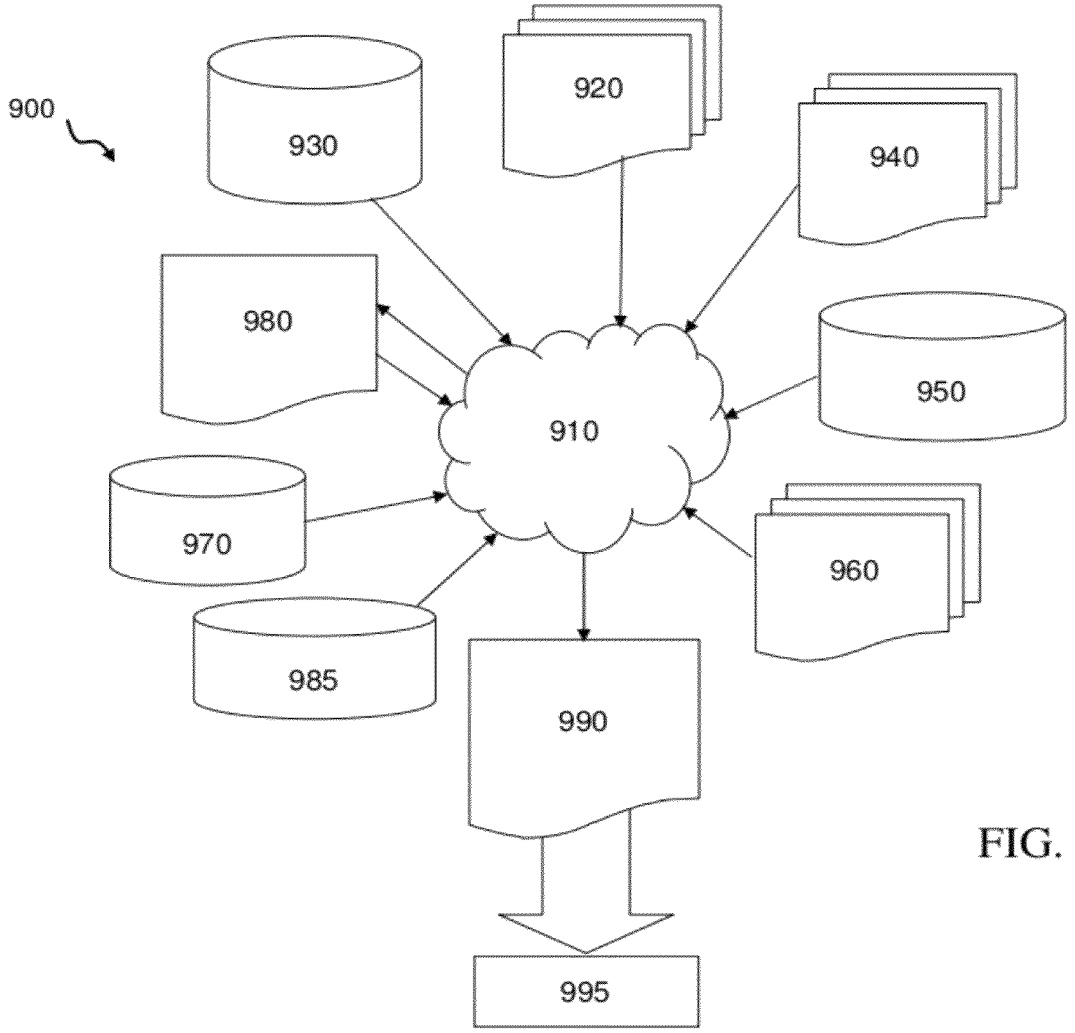
FIG. 14 is a flow diagram of a design process used in semiconductor design, manufacture, and/or test.

FIG. 14 shows a block diagram of an exemplary design flow 900 used for example, in semiconductor IC logic design, simulation, test, layout, and manufacture. Design flow 900 includes processes, machines and/or mechanisms for processing design structures or devices to generate logically or otherwise functionally equivalent representations of the design structures and/or devices described above and shown in FIGS. 2-7. The design structures processed and/or generated by design flow 900 may be encoded on machine-readable transmission or storage media to include data and/or instructions that when executed or otherwise processed on a data processing system generate a logically, structurally, mechanically, or otherwise functionally equivalent representation of hardware components, circuits, devices, or systems. Machines include, but are not limited to, any machine used in an IC design process, such as designing, manufacturing, or simulating a circuit, component, device, or system. For example, machines may include: lithography machines, machines and/or equipment for generating masks (e.g. e-beam writers), computers or equipment for simulating design structures, any apparatus used in the manufacturing or test process, or any machines for programming functionally equivalent representations of the design structures into any medium (e.g. a machine for programming a programmable gate array).

Design flow 900 may vary depending on the type of representation being designed. For example, a design flow 900 for building an application specific IC (ASIC) may differ from a design flow 900 for designing a standard component or from a design flow 900 for instantiating the design into a programmable array, for example a programmable gate array (PGA) or a field programmable gate array (FPGA) offered by Altera® Inc. or Xilinx® Inc.

FIG. 14 illustrates multiple such design structures including an input design structure 920 that is preferably processed by a design process 910. Design structure 920 may be a logical simulation design structure generated and processed by design process 910 to produce a logically equivalent functional representation of a hardware device. Design structure 920 may also or alternatively comprise data and/or program instructions that when processed by design process 910, generate a functional representation of the physical structure of a hardware device. Whether representing functional and/or structural design features, design structure 920 may be generated using electronic computer-aided design (ECAD) such as implemented by a core developer/designer. When encoded on a machine-readable data transmission, gate array, or storage medium, design structure 920 may be accessed and processed by one or more hardware and/or software modules within design process 910 to simulate or otherwise functionally represent an electronic component, circuit, electronic or logic module, apparatus, device, or system such as those shown in FIGS. 2-7. As such, design structure 920 may comprise files or other data structures including human and/or machine-readable source code, compiled structures, and computer-executable code structures that when processed by a design or simulation data processing system, functionally simulate or otherwise represent circuits or other levels of hardware logic design. Such data structures may include hardware-description language (HDL) design entities or other data structures conforming to and/or compatible with lower-level HDL design languages such as Verilog and VHDL, and/or higher level design languages such as C or C++.

Design process 910 preferably employs and incorporates hardware and/or software modules for synthesizing, translating, or otherwise processing a design/simulation functional equivalent of the components, circuits, devices, or logic structures shown in FIGS. 2-7 to generate a netlist 980 which may contain design structures such as design structure 920. Netlist 980 may comprise, for example, compiled or otherwise processed data structures representing a list of wires, discrete components, logic gates, control circuits, I/O devices, models, etc. that describes the connections to other elements and circuits in an integrated circuit design. Netlist 980 may be synthesized using an iterative process in which netlist 980 is resynthesized one or more times depending on design specifications and parameters for the device. As with other design structure types described herein, netlist 980 may be recorded on a machine-readable data storage medium or programmed into a programmable gate array. The medium may be a non-volatile storage medium such as a magnetic or optical disk drive, a programmable gate array, a compact flash, or other flash memory. Additionally, or in the alternative, the medium may be a system or cache memory, buffer space, or electrically or optically conductive devices and materials on which data packets may be transmitted and intermediately stored via the Internet, or other networking suitable means.

Design process 910 may include hardware and software modules for processing a variety of input data structure types including netlist 980. Such data structure types may reside, for example, within library elements 930 and include a set of commonly used elements, circuits, and devices, including models, layouts, and symbolic representations, for a given manufacturing technology (e.g., different technology nodes, 32 nm, 45 nm, 90 nm, etc.). The data structure types may further include design specifications 940, characterization data 950, verification data 960, design rules 970, and test data files 985 which may include input test patterns, output test results, and other testing information. Design process 910 may further include, for example, standard mechanical design processes such as stress analysis, thermal analysis, mechanical event simulation, process simulation for operations such as casting, molding, and die press forming, etc. One of ordinary skill in the art of mechanical design can appreciate the extent of possible mechanical design tools and applications used in design process 910 without deviating from the scope and spirit of the invention. Design process 910 may also include modules for performing standard circuit design processes such as timing analysis, verification, design rule checking, place and route operations, etc.

Design process 910 employs and incorporates logic and physical design tools such as HDL compilers and simulation model build tools to process design structure 920 together with some or all of the depicted supporting data structures along with any additional mechanical design or data (if applicable), to generate a second design structure 990. Design structure 990 resides on a storage medium or programmable gate array in a data format used for the exchange of data of mechanical devices and structures (e.g. information stored in a IGES, DXF, Parasolid XT, JT, DRG, or any other suitable format for storing or rendering such mechanical design structures). Similar to design structure 920, design structure 990 preferably comprises one or more files, data structures, or other computer-encoded data or instructions that reside on transmission or data storage media and that when processed by an ECAD system generate a logically or otherwise functionally equivalent form of one or more of the embodiments of the invention shown in FIGS. 2-7. In one embodiment, design structure 990 may comprise a compiled, executable HDL simulation model that functionally simulates the devices shown in FIGS. 2-7.

Design structure 990 may also employ a data format used for the exchange of layout data of integrated circuits and/or symbolic data format (e.g. information stored in a GDSII (GDS2), GL1, OASIS, map files, or any other suitable format for storing such design data structures). Design structure 990 may comprise information such as, for example, symbolic data, map files, test data files, design content files, manufacturing data, layout parameters, wires, levels of metal, vias, shapes, data for routing through the manufacturing line, and any other data required by a manufacturer or other designer/developer to produce a device or structure as described above and shown in FIGS. 2-7. Design structure 990 may then proceed to a stage 995 where, for example, design structure 990: proceeds to tape-out, is released to manufacturing, is released to a mask house, is sent to another design house, is sent back to the customer, etc.

The method as described above is used in the fabrication of integrated circuit chips. The resulting integrated circuit chips can be distributed by the fabricator in raw wafer form (that is, as a single wafer that has multiple unpackaged chips), as a bare die, or in a packaged form. In the latter case the chip is mounted in a single chip package (such as a plastic carrier, with leads that are affixed to a motherboard or other higher level carrier) or in a multichip package (such as a ceramic carrier that has either or both surface interconnections or buried interconnections). In any case the chip is then integrated with other chips, discrete circuit elements, and/or other signal processing devices as part of either (a) an intermediate product, such as a motherboard, or (b) an end product. The end product can be any product that includes integrated circuit chips, ranging from toys and other low-end applications to advanced computer products having a display, a keyboard or other input device, and a central processor.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below, where applicable, are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated. Accordingly, while the invention has been described in terms of embodiments, those of skill in the art will recognize that the invention can be practiced with modifications and in the spirit and scope of the appended claims.

What is claimed:

1. A on-chip transmission line, comprising:

a signal line;

an upper ground line spaced apart from and above the signal line; and a lower ground line spaced apart from and below the signal line, wherein the signal line, the upper ground line and the lower ground line are substantially vertically aligned in a dielectric material, and the signal line, the upper ground line and the lower ground line are arranged in different respective wiring levels of a chip.

2. The on-chip transmission line of claim 1, wherein the signal line, the upper ground line and the lower ground line have a same thickness in a horizontal direction.

3. The on-chip transmission line of claim 1, wherein:

the dielectric material surrounds each of the signal line, the upper ground line, and the lower ground line, the on-chip transmission line comprises a vertical coplanar waveguide, and an electrical field of the vertical coplanar waveguide exists completely or almost completely within the dielectric material.

4. The on-chip transmission line of claim 1, wherein the lower ground line spans a plurality of wiring levels.

5. The on-chip transmission line of claim 4, wherein the signal line and the upper ground line are each contained within a respective single or a plurality of wiring levels.

6. The on-chip transmission line of claim 1, further comprising:

at least one metal strip adjacent to and spaced apart from a first side of the signal line, the upper ground line and the lower ground line; and at least one other metal strip adjacent to and spaced apart from a second side of the signal line, the upper ground line and the lower ground line, wherein the first side is opposite the second side.

7. The on-chip transmission line of claim 6, wherein the at least one metal strip and the at least one other metal strip are floating relative to the upper ground line and the lower ground line.

8. The on-chip transmission line of claim 6, wherein the at least one metal strip and the at least one other metal strip are directly connected to the upper ground line and the lower ground line.

9. The on-chip transmission line of claim 6, wherein:

the at least one metal strip comprises a first plurality of metal strips spaced apart along a length of the signal line, the upper ground line and the lower ground line, and the at least one other metal strip comprises a second plurality of metal strips spaced apart along a length of the signal line, the upper ground line and the lower ground line.

10. The on-chip transmission line of claim 9, wherein at least one of:

a thickness of the signal line, the upper ground line and the lower ground line;

a distance between (i) the signal line, the upper ground line and the lower ground line and (ii) the at least one metal strip;

a distance between (i) the signal line, the upper ground line and the lower ground line and (ii) and the at least one other metal strip;

a width of each one of the first plurality of metal strips and second plurality of metal strips; and a spacing between respective ones of the first plurality of metal strips and second plurality of metal strips, are configured such that a characteristic impedance of the transmission line is in a range of about 35 Ohm to about 75 Ohm.

11. A on-chip transmission line, comprising:

a signal line;

an upper ground line spaced apart from and above the signal line; and a lower ground line spaced apart from and below the signal line, wherein the signal line, the upper ground line and the lower ground line are substantially vertically aligned in a dielectric material, the lower ground line spans a plurality of wiring levels, the signal line and the upper ground line are each contained within a respective single or a plurality of wiring levels, the lower ground line has a height of about 3.56 μm, the signal line has a height of about 1.25 μm, and the upper ground line has a height of about 4 μm.

12. A design structure tangibly embodied in a machine readable memory used for designing, manufacturing, or testing an integrated circuit, the design structure comprising:

a signal line;

an upper ground line spaced apart from and above the signal line; and a lower ground line spaced apart from and below the signal line, wherein the signal line, the upper ground line and the lower ground line are substantially vertically aligned in a dielectric material, and the signal line, the upper ground line and the lower ground line are arranged in different respective wiring levels of a chip.

13. The design structure of claim 12, wherein the design structure comprises a netlist.

14. The design structure of claim 12, wherein the design structure resides on storage medium as a data format used for the exchange of layout data of integrated circuits.

15. The design structure of claim 12, wherein the design structure resides in a programmable gate array.

16. A method of fabricating a semiconductor structure, comprising:

forming a lower ground line of an on-chip transmission line in at least one wiring level above an active device;

forming a signal line of the on-chip transmission line in a second wiring level above the at least one wiring level; and forming an upper ground line of the on-chip transmission line in a third wiring level above the second wiring level, wherein the on-chip transmission line comprises a vertical coplanar wave guide formed in a single type of material, and an electrical field of the vertical coplanar waveguide exists completely or almost completely within the single type of material.

17. The method of claim 16, wherein the lower ground line, signal line, and upper ground line are formed in substantial vertical alignment.

18. The method of claim 16 further comprising:

forming a first plurality of metal strips adjacent to and spaced apart from a first side of the signal line, the upper ground line and the lower ground line; and forming a second plurality of metal strips adjacent to and spaced apart from a second side of the signal line, the upper ground line and the lower ground line, wherein the first side is opposite the second side.

19. The method of claim 18, further comprising tuning a characteristic impedance of the transmission line to a range of about 35 Ohm to about 75 Ohm by adjusting at least one of:

a thickness of the signal line, the upper ground line and the lower ground line;

a distance between (i) the first side of the signal line, the upper ground line and the lower ground line and (ii) the first plurality of metal strips;

a distance between (i) the second side of the signal line, the upper ground line and the lower ground line and (ii) the second plurality of metal strips;

a width of each one of the first plurality of metal strips and second plurality of metal strips; and a spacing between respective ones of the first plurality of metal strips and second plurality of metal strips.

20. A method of fabricating a semiconductor structure, comprising:

forming a lower ground line of an on-chip transmission line in at least one wiring level above an active device;

forming a signal line of the on-chip transmission line in a second wiring level above the at least one wiring level; and forming an upper ground line of the on-chip transmission line in a third wiring level above the second wiring level, wherein the at least one wiring level are formed as a plurality of wiring levels and a plurality of via levels, and the forming the lower ground line comprises arranging conductor material in each of the plurality of wiring levels and the plurality of via levels.

* * * * *